US011819071B2

(12) United States Patent
Tomb et al.

(10) Patent No.: US 11,819,071 B2
(45) Date of Patent: Nov. 21, 2023

(54) THERMAL GLOVE FOR USE IN HAIR STYLING

(71) Applicants: Rebecca H Tomb, Lexington, KY (US); Sabrina Jahnigen, Lexington, KY (US)

(72) Inventors: Rebecca H Tomb, Lexington, KY (US); Sabrina Jahnigen, Lexington, KY (US)

( * ) Notice: Subject to any disclaimer, the term of this patent is extended or adjusted under 35 U.S.C. 154(b) by 0 days.

(21) Appl. No.: 17/179,392

(22) Filed: Feb. 18, 2021

(65) Prior Publication Data

US 2021/0259337 A1 Aug. 26, 2021

Related U.S. Application Data

(60) Provisional application No. 62/979,135, filed on Feb. 20, 2020.

(51) Int. Cl.
*A41D 19/015* (2006.01)

(52) U.S. Cl.
CPC ..... *A41D 19/01529* (2013.01)

(58) Field of Classification Search
CPC ..... A41D 19/01529; A41D 19/01535; A41D 31/06; A41D 19/0096; A41D 19/01505; A41D 19/01511; A41D 19/01541; A41D 2400/10
See application file for complete search history.

(56) References Cited

U.S. PATENT DOCUMENTS 6,374,417 B1 * 4/2002 Stagnitta ..... A41D 19/01547 2/163
6,457,182 B1 * 10/2002 Szczesuil ..... A41D 19/01511 2/167
9,301,557 B1 * 4/2016 Santos ..... B32B 5/02
2008/0120761 A1 * 5/2008 Yang ..... B32B 5/04 2/167
2009/0019614 A1 * 1/2009 Hagihara ..... D02G 3/443 2/167

(Continued)

FOREIGN PATENT DOCUMENTS

WO WO-2018127870 A2 * 7/2018 ..... A41D 19/015

OTHER PUBLICATIONS

"Stainless Steel 1.4404 Material Data Sheet"; thyssenkrupp Materials; Nov. 2017 (Year: 2017).*

*Primary Examiner* — Sally Haden
*Assistant Examiner* — Grady Alexander Nunnery
(74) *Attorney, Agent, or Firm* — Stockwell & Smedley, PSC

(57) ABSTRACT

A glove for use in hair styling applications, comprising: a glove body with an inner cavity therein generally conforming to a shape of a human hand, the body portion including an outer surface defining a front side with a palm area and an opposing back side of the glove body, a first end portion having an opening to the inner cavity and an opposing second end portion including a plurality of finger stalls extending from the glove body, the body portion being constructed of a first material; and a plurality of elements coupled to discrete areas of the body portion, wherein the elements are constructed of a second material, the second material having a property of greater thermal conductivity as compared with the first material.

9 Claims, 7 Drawing Sheets

(56) References Cited

U.S. PATENT DOCUMENTS

| | | | | |
|---|---|---|---|---|
| 2009/0049871 | A1* | 2/2009 | Klett | A41D 13/005 66/171 |
| 2010/0186456 | A1* | 7/2010 | Zhu | D02G 3/442 2/168 |
| 2014/0172134 | A1* | 6/2014 | Meschter | A61B 5/6804 73/865.4 |
| 2014/0173805 | A1* | 6/2014 | Hassan | A41D 19/0055 2/167 |
| 2014/0259255 | A1* | 9/2014 | Ragan | A41D 31/085 2/161.6 |
| 2017/0000202 | A1* | 1/2017 | Hassan | A41D 31/065 |
| 2017/0168577 | A1* | 6/2017 | Keller | G06F 3/016 |
| 2017/0238636 | A1* | 8/2017 | Einesson | A41D 19/0006 |
| 2020/0093204 | A1* | 3/2020 | Feng | A41D 19/0068 |

* cited by examiner

FIG. 1
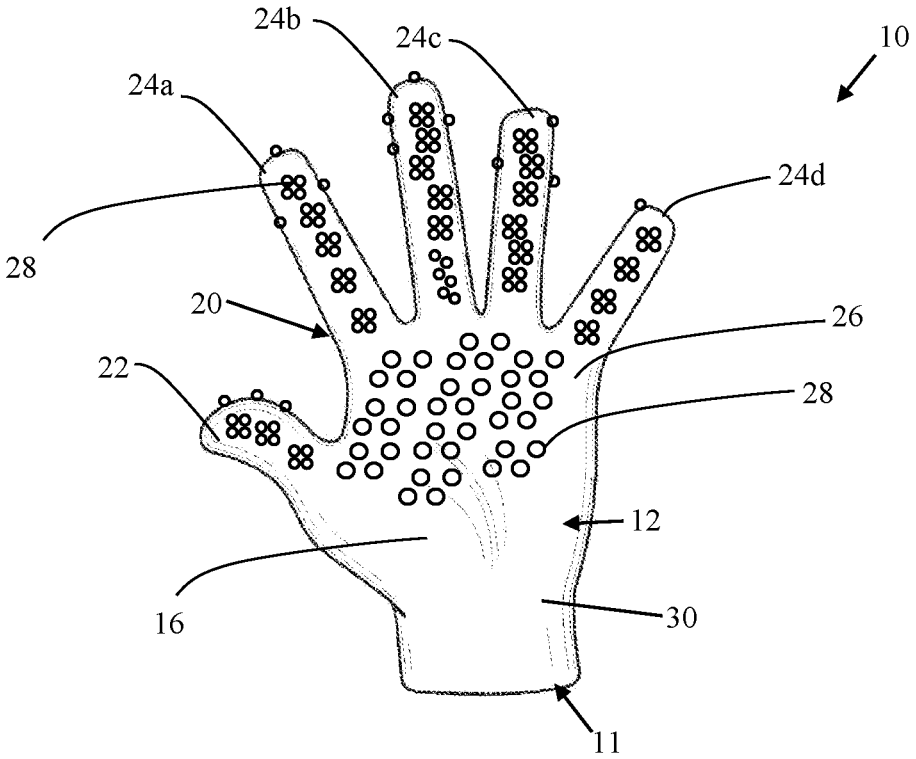
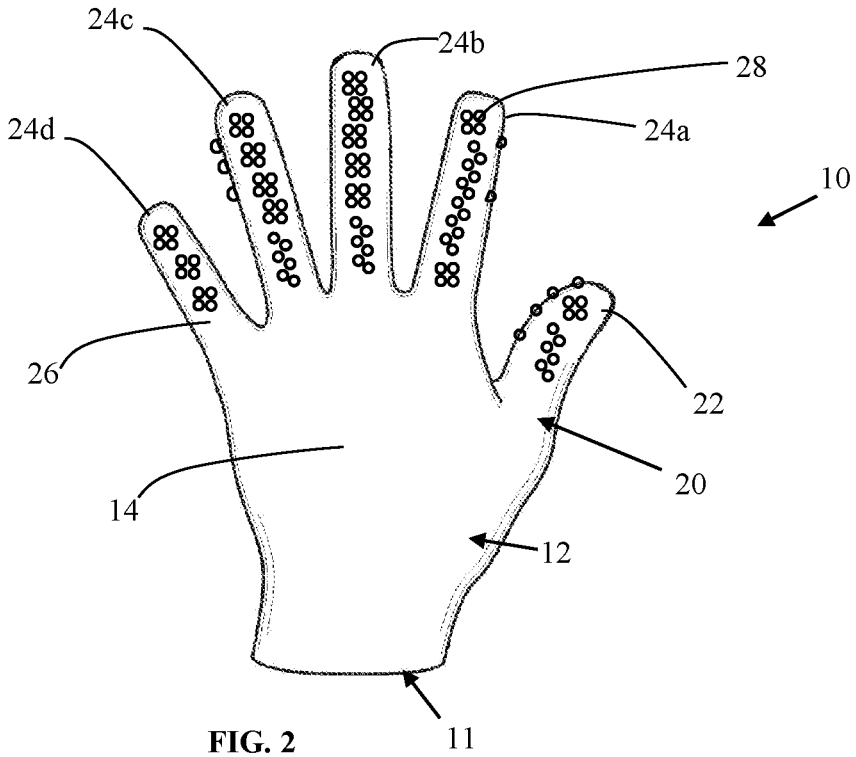
FIG. 2

FIG. 3
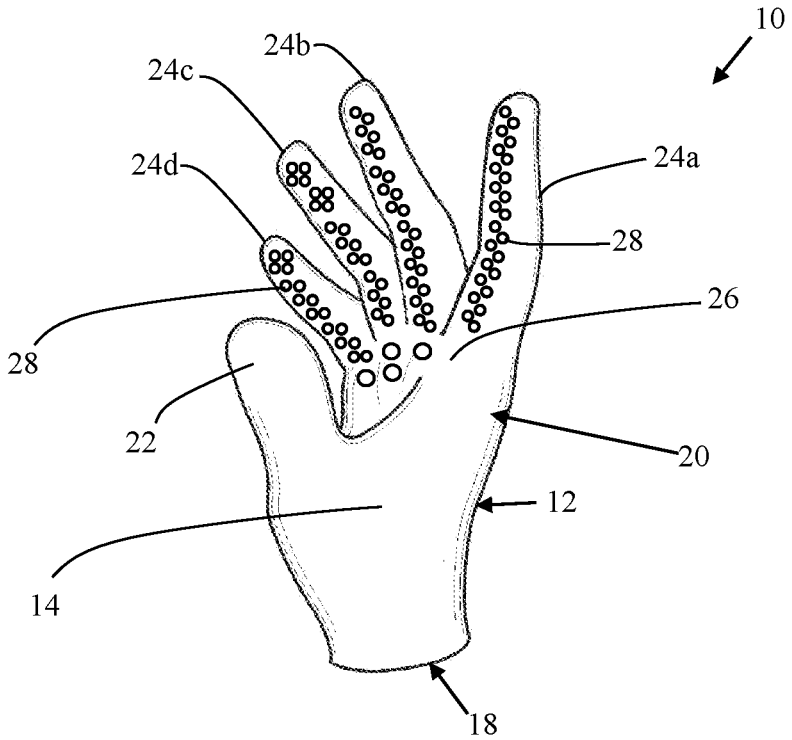
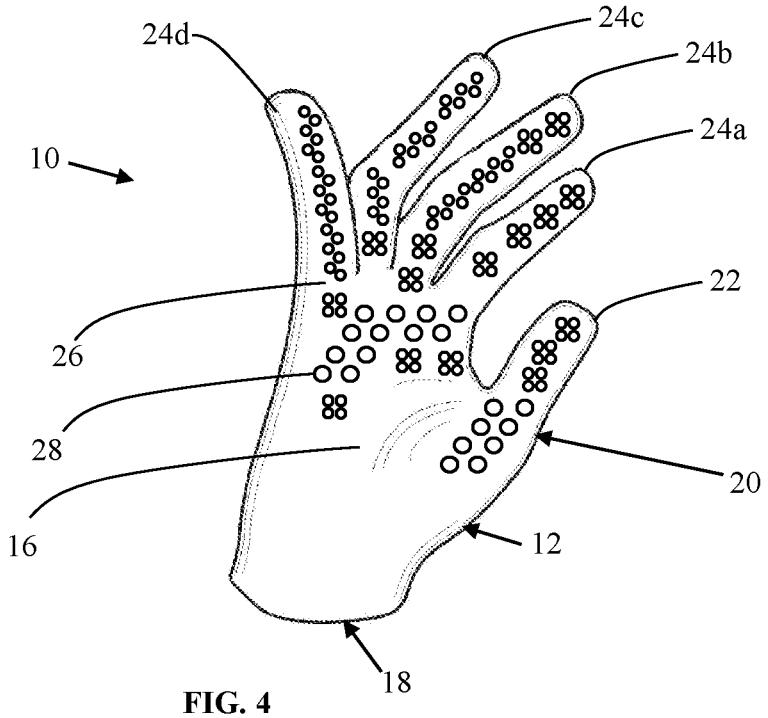
FIG. 4

FIG. 5
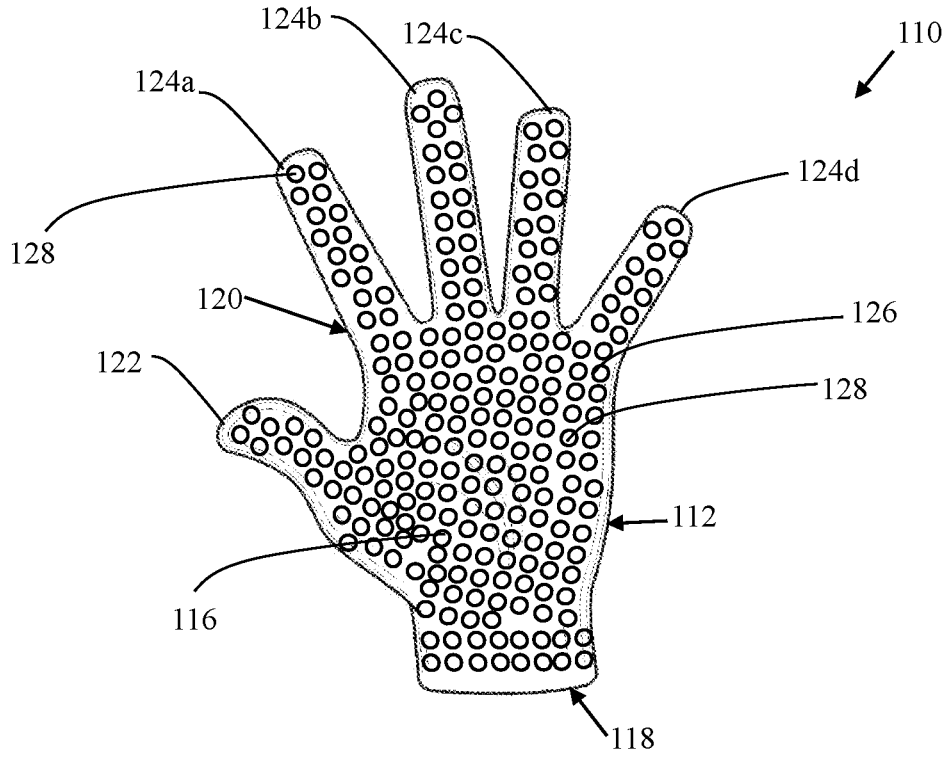
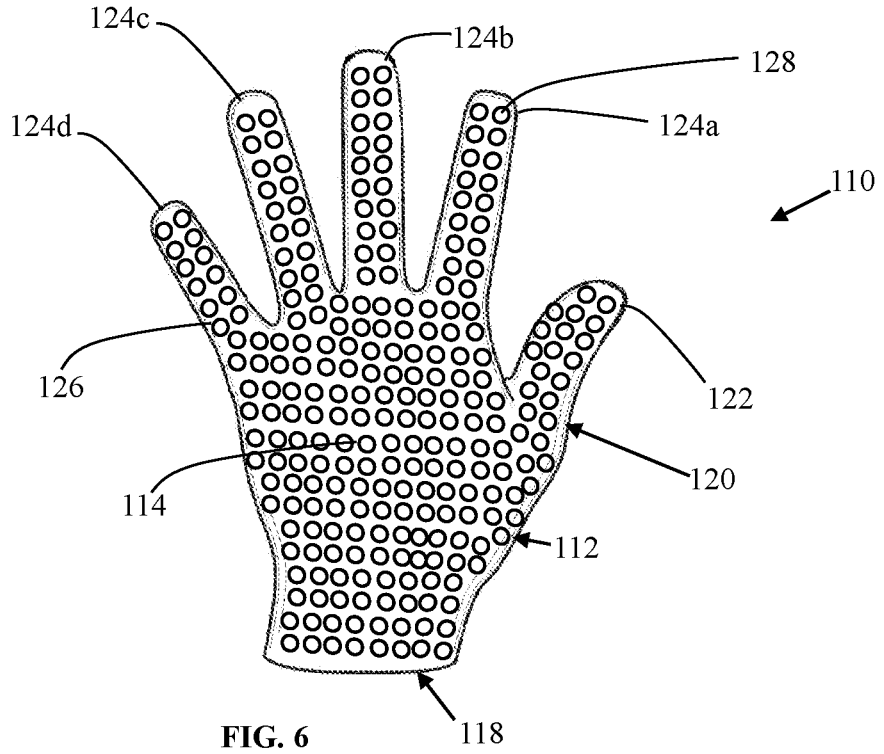
FIG. 6

FIG. 7
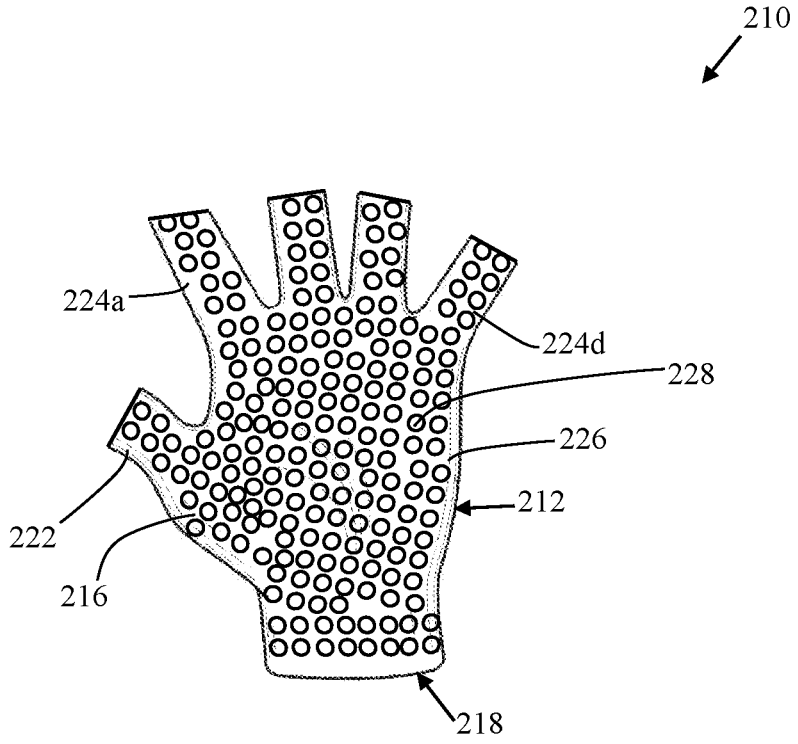
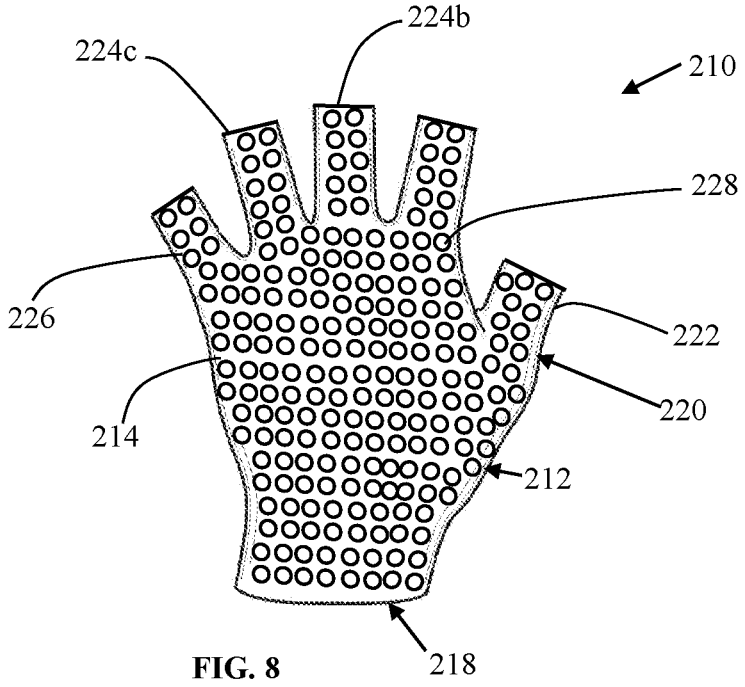
FIG. 8

FIG. 10
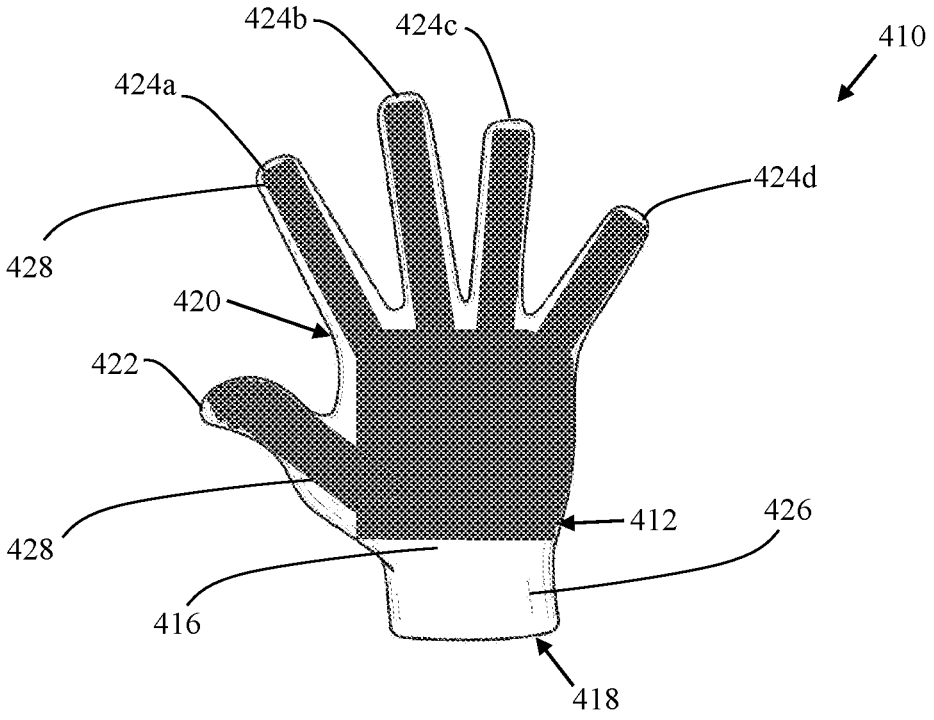
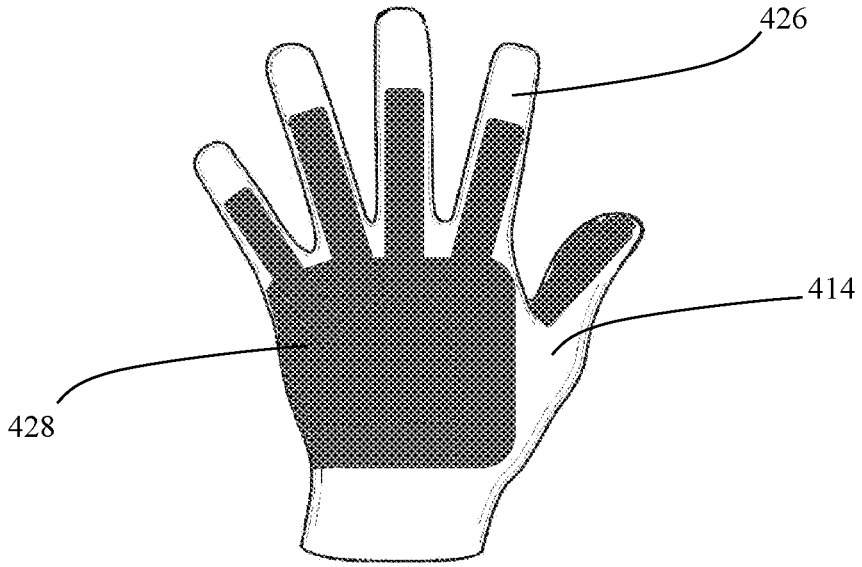
FIG. 11

FIG. 12
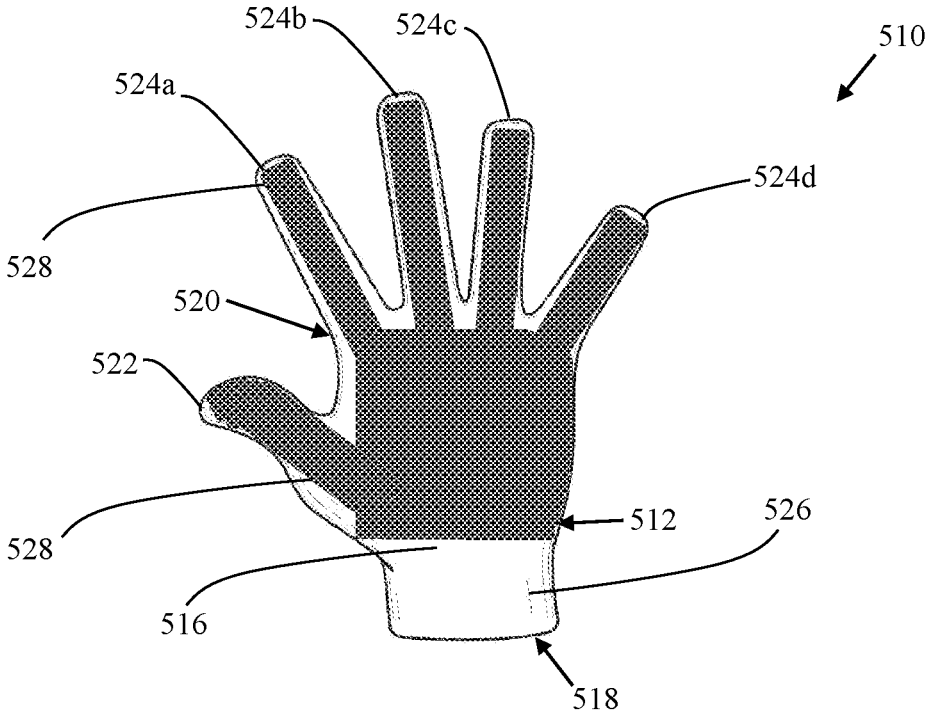
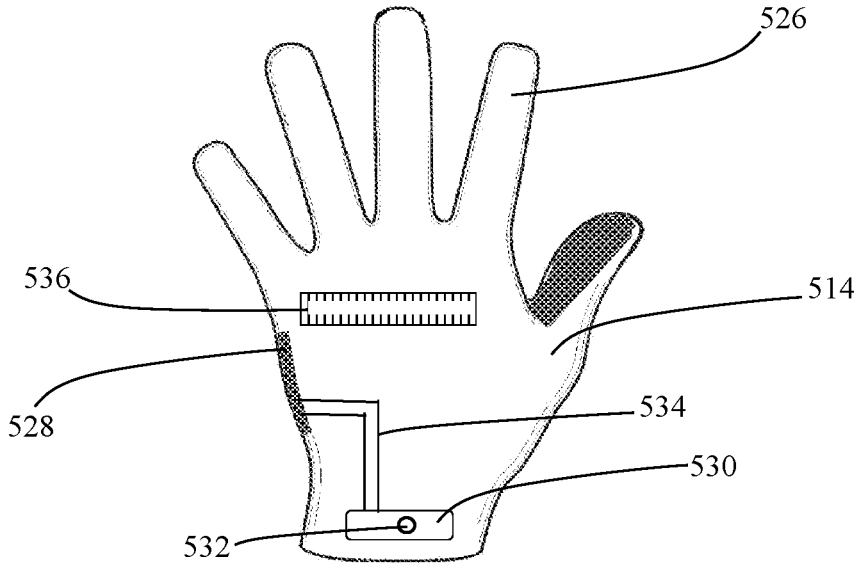
FIG. 13

THERMAL GLOVE FOR USE IN HAIR STYLING

CROSS-REFERENCE TO RELATED APPLICATIONS

This application claims the priority benefit of U.S. provisional patent application No. 62/979,135 filed on Feb. 20, 2020, the disclosure of which is incorporated herein by reference.

BACKGROUND OF THE INVENTION

The invention relates to devices used for styling hair, and in particular, a thermal glove for use in hair styling.

Many people style their hair using brushes, combs, curling irons, blow dryers and other implements. It can be helpful or even necessary to apply heat to the hair in order to create a desired style. The process often involves using multiple implements at the same time, such as blow drying the hair as the hair is manipulated with a brush or comb.

For example, when simultaneously blow drying and brushing hair with a round brush, desirable results can be achieved by pulling the bristles of a hair brush through the hair while heat from a hair dryer is applied directly to the hair. A user can usually rotate the brush manually and, after each turn, the user pulls the brush from the hair, all while the hair is being exposed to hot air from the hair dryer. The brush is then replaced in a new location, usually adjacent to the preceding location, and the process is repeated.

It should be apparent in the above example that accomplishing rotation evenly over all regions of a person's head is difficult because it is unnatural for a user to rotate his or her hand to the necessary positions, particularly while simultaneously maintaining control of the hair dryer. Specifically, blow drying one's own hair requires reaching around the head with the arms raised, and in that position, providing the proper twist or rotation to the brush is very difficult. Coordinating brush movement while aiming the dryer substantially adds to the level of difficulty, particularly for people that have physical challenges or conditions that restrict movement. Round brushes also have a tendency to get caught or tangled in the hair, which can be both painful and damaging to the hair. Hair stylists can accomplish these positions more easily because they can move relative to a person's head but it would be expensive if not impractical for a person to continually seek the help of a hair stylist.

In addition to brushing hair, it is often desirable to style one's hair in a particular manner, such as curling straight hair or straightening curly hair. Usually, a separate apparatus in addition to a brush is necessary to curl, straighten, or otherwise style the hair, which makes the process even more difficult.

Thus, in view of the above, there is a long-felt need to address the aforementioned inefficiencies and inadequacies. Further limitations and disadvantages of conventional and traditional approaches will become apparent to one of skill in the art through comparison of described methods and systems disclosed herein.

SUMMARY OF THE INVENTION

The invention has many important advantages overcoming the deficiencies cited above, among other things. It should be understood that the scope of the invention is not intended to be limited to the embodiments of the invention described herein. Those of skill in the art may be able to produce embodiments different from the embodiments described and depicted herein in order to better suit varying needs or preferences, while remaining in the scope of the invention.

Some embodiments of the invention are directed to a tool used with a blow dryer to create volume and control unruly hair, to achieve the same results that the combination of round brushes, curling irons and blow dryers do, but with greater ease, mobility and without the potential for harm.

Some embodiments of the invention are directed to a glove or pair of gloves which may be worn on at least a portion of a user's hand, and includes an element capable of heat transfer, hereinafter referred to as a thermally conductive element, which is operatively associated with the glove.

Some embodiments of the invention are directed to a glove for use in hair styling applications, comprising: a glove body with an inner cavity therein generally conforming to a shape of a human hand, the body portion including an outer surface defining a front side with a palm area and an opposing back side of the glove body, a first end portion having an opening to the inner cavity and an opposing second end portion including a plurality of finger stalls extending from the glove body, the body portion being constructed of a first material; and a plurality of elements coupled to discrete areas of the body portion, wherein the elements are constructed of a second material, the second material having a property of greater thermal conductivity as compared with the first material.

In some embodiments of the aforementioned glove, the plurality of elements further comprise one or more elements on the front side of the glove body and one or more elements on the back side of the glove body, wherein the one or more elements on the front side and the one or more elements on the back side are in thermal communication whereby heat transferred to the one or more elements on the back side is diffused to the or more elements on the front side of the glove body.

In some embodiments of the aforementioned glove, the first material has properties such as for example, being a woven material, insulative, heat resistant or moisture/water absorbent.

In some embodiments of the aforementioned glove, the first material is insulative.

In some embodiments of the aforementioned glove, the plurality of elements comprise groupings of elements on the plurality of finger stalls of the front side of the glove body.

In some embodiments of the aforementioned glove, the plurality of elements comprise one or more substantially planar substrates, such as domed shapes, beads, hemispherical shapes, squares or other shapes.

In some embodiments, the elements comprise one or more discs. The one or more discs may comprise groups of discs coupled to the glove body on the front side finger stalls and palm area. The groups of discs may comprise at least two discs in contact with one another. The discs may have the same or varying diameter or shape.

In some embodiments of the aforementioned glove, the plurality of elements comprise one or more strips of a mesh material. The one or more strips may be coupled on the finger stall and palm area of the front side. The one or more strips may be coupled on the finger stall and palm area of the front side and the back side of the glove body. The strips may be independent or in contact with one another. In some embodiments, the body of the glove is substantially covered or coated with a mesh material.

In some embodiments of the aforementioned glove, the first material has a thermal conductivity less than 1 W/mk at room temperature.

In some embodiments of the aforementioned glove, the second material has a thermal conductivity of greater than 15 W/mk at room temperature.

In some embodiments the glove further comprises a temperature indicator coupled to the glove body, wherein the temperature indicator indicates unsafe temperature to human hair.

In some embodiments of the aforementioned glove, the plurality of elements are in thermal communication with one another and coupled to the glove body to provide heat transfer to at least the finger stalls and the palm area of the front side.

In some embodiments, the aforementioned glove further comprises a powered heat source configured to provide heat transfer to the plurality of elements.

Some embodiments of the invention are also directed to a glove for use in hair styling applications, comprising: a glove body with an inner cavity therein generally conforming to a shape of a human hand, the body portion including an outer surface defining a front side with a palm area and an opposing back side of the glove body, a first end portion having an opening to the inner cavity and an opposing second end portion including a plurality of finger stalls extending from the glove body, the body portion being constructed of a first material; and a plurality of elements coupled to the discrete areas of the palm area and the plurality of finger stalls, wherein the plurality of elements include substrates constructed of a second material, the second material having a property of greater thermal conductivity as compared with the first material, and the substrates being in thermal communication with one another.

In some embodiments of the aforementioned glove, one or more substrates are coupled to the palm area and finger stalls of the front side of the glove body and one or more substrates are coupled to the back side of the glove body, wherein the one or more substrates coupled to the palm area and finger stalls of the front side of the glove body and the one or more substrates coupled to the back side of the glove body are in thermal communication whereby heat transferred to the one or more substrates on the back side is diffused to the or more substrates on the front side of the glove body.

Yet other objects and advantages of the invention will become readily apparent to those skilled in the art, following the detailed description, wherein various presently preferred and exemplary embodiments of the invention are shown and described. As discussed herein, the invention is capable of other and different embodiments, and its several details are capable of modifications in various obvious respects, all without departing from the scope of the invention. Accordingly, the drawings and description thereof are to be regarded as illustrative in nature, and not as restrictive.

BRIEF DESCRIPTION OF THE DRAWINGS

These and other aspects of the systems and methods of the invention will become more readily apparent to those having ordinary skill in the art from the following description of an exemplary embodiment of the invention taken in conjunction with the accompanying drawings, wherein like reference numerals may refer to like parts.

FIG. 1 illustrates a front view of a left-handed glove constructed in accordance with some exemplary embodiments of the invention;

FIG. 2 illustrates a back view of the glove of FIG. 1;

FIG. 3 illustrates a front view of a right-handed glove constructed in correspondence with the exemplary embodiments of the invention shown in FIG. 1;

FIG. 4 illustrates a back view of the glove of FIG. 3;

FIG. 5 illustrates a front view of a right-handed glove constructed in accordance with other exemplary embodiments of the invention;

FIG. 6 illustrates a back view of the glove of FIG. 5;

FIG. 7 illustrates a front view of a right-handed glove constructed in accordance with yet other exemplary embodiments of the invention;

FIG. 8 illustrates a back view of the glove of FIG. 7;

FIG. 10 illustrates a front view of a glove constructed in accordance with yet other exemplary embodiments of the invention;

FIG. 11 illustrates a back view of the glove of FIG. 10;

FIG. 12 illustrates a front view of a glove constructed in accordance with yet other exemplary embodiments of the invention; and FIG. 13 illustrates a back view of the glove of FIG. 12.

DETAILED DESCRIPTION OF SOME EMBODIMENTS OF THE INVENTION

Figure 9:
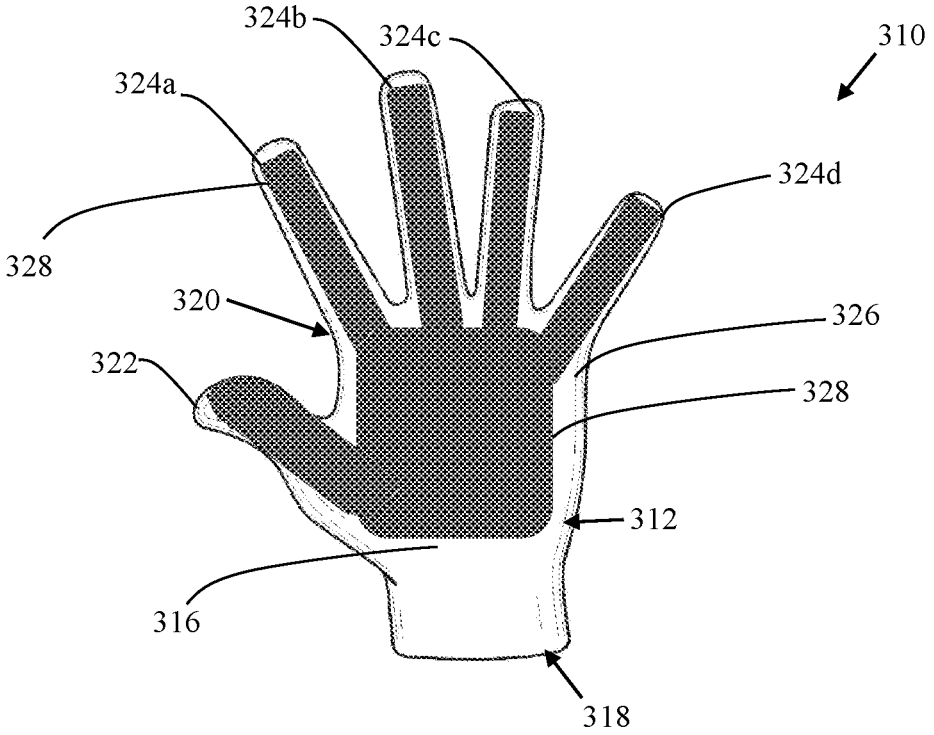
FIG. 9 illustrates a front view of a glove constructed in accordance with other exemplary embodiments of the invention.

The invention may be best understood with reference to the detailed figures and description set forth herein. Various embodiments have been discussed with reference to the figures. However, those skilled in the art will readily appreciate that the detailed descriptions provided herein with respect to the figures are merely for explanatory purposes, as the methods and systems may extend beyond the described embodiments. For instance, the teachings presented, and the needs of a particular application, may yield multiple alternative and suitable approaches to implement the functionality of any detail described herein. Therefore, any approach may extend beyond certain implementation choices in the disclosed embodiments.

FIGS. 1-4 illustrate an exemplary pair of gloves including thermally conductive elements, with each glove, whether left-hand and right handed, being generally referred to by the reference numeral 10. It should be readily apparent that the invention includes the use of a single glove as well as a pair of gloves, and a configuration shown on the left-handed glove 10 may be alternately employed on the right-handed glove 10, and vice versa.

It should be understood that the term "glove" as used herein is intended to mean any flexible material that covers a portion of a user's hand thereby forming a non-permanent engagement with the user's hand. The term glove can refer to a wearable item which mostly or entirely covers the user's hand and has separate portions for individually receiving some or all of a user's fingers, or without such separate finger portions, such as a mitten, or a material which covers a portion of the user's hand and may be attached by a separate engagement member, such as an elastic band.

In some exemplary embodiments provided herein, a glove of the invention is a non-powered implement to be worn on a user's hand and composed of thermally conductive elements sewn into a non-conductive material which enables the glove body to be heated when exposed to hot air emitted by a blow dryer.

Glove 10 includes a body 12 comprising a back side 14, a front side 16, a first open end 18 and a second end 20. First open end 18 includes an opening generally configured for a user to insert their hand therein, with back side 14 corresponding to the backhand side of a user's hand and front side 16 corresponding with the front or palm side of a user's hand. Second end 20 includes generally cylindrical receiving portions for the user's fingers, that is, a thumb stall 22 for receiving a user's thumb and finger stalls 24*a*, 24*b*, 24*c* and 24*d* for receiving a user's index, middle, ring and little finger, respectively. In this embodiment, each stall 22 and 24*a-d* has a closed end, thus covering the fingertips of a user's fingers inserted therein. In other embodiments the ends are open to allow fingertips to extend from stalls 22 and 24*a-d* of body 12.

Glove 10 is generally constructed of a flexible material wherein all or one or more portions of body 12 include non-thermally conductive elements 26 and thermally conductive elements 28. In some embodiments, the thermally conductive element(s) 28 is attached to the glove of the invention. In other embodiments, the thermally conductive element(s) 28 is embedded in the glove. In yet other embodiments, the thermally conductive element(s) 28 is in the shape of flexible elongated members, fibers or threads which are interspersed, wrapped around, sewn or woven within or with the fibers of material forming the glove.

In this embodiment, non-thermally conductive elements 26 comprises a material also forming a portion or all of body 12 and thermally conductive elements 28 which are coupled to the material. It should be understood that the terms "non-thermally conductive" and "thermally conductive" refer to general thermal properties including thermal conductivity and diffusivity, among other things relating to the ability of elements 28 to absorb, transfer and diffuse heat. These properties may be relative to one another, that is, non-thermally conductive elements 26 may range from being a material that is substantially non-thermally conductive to a material that is thermally conductive but less so than thermally conductive elements 28. For illustrative purposes, thermally conductive elements of the invention such as elements 28 may have a thermal conductivity in the range of about 15 to about 800 W/mK and a thermal diffusivity in the range of about 3 to about $200\times10^{-6}$ $m^2/s$, whereas non-thermally conductive elements of the invention such as elements 26 may have a thermal conductivity below 15 W/mK and a thermal diffusivity of less than $3\times10^{-6}$ $m^2/s$. In some embodiments, the non-thermally conductive elements of the invention such as elements 26 have a thermal conductivity below 1 W/mK.

In some embodiments, non-thermally conductive elements 26 are embedded in body 12 to, among other things, facilitate retaining heat in thermally conductive elements 28. For example, body 12 may be constructed of a fabric embedded with ceramic. In some embodiments, body 12 may be infused with thermally conductive elements 28, and have non-thermally conductive elements 26 embedded therein to retain heat and prevent heat loss from thermally conductive elements 28. In some embodiments, thermally conductive elements 28 may be partially or fully coated with non-thermally conductive elements 26 and embedded, infused or otherwise attached or affixed to body 12.

In this embodiment, thermally conductive elements 28 comprise independent substrates which are positioned around various parts of body 12, such as thumb stall 22, finger stalls 24*a-d* and front side 16. While elements 28 are depicted in the figures as circular-shaped, disc-like, hemispherical or domed, it should be readily apparent that elements 28 may be of any size or shape. Elements 28 may also be coupled or connected to non-conductive elements 26 or body 12 either randomly and/or in patterns or groupings using any conventional method for securing elements 28 on the material of elements 26, such as through use of adhesives and/or mechanical fasteners and fastening methods (such as being sewn on), which may depend in part on the type of materials used to form elements 26 and elements 28. Groupings of elements 28 as shown in the figures may advantageously facilitate heat transfer over a greater surface area of glove 10.

It should be understood that non-thermally conductive elements 26 and conductive elements 28 may or may not be uniformly distributed in material 30. In some embodiments, the conductive elements 28 are in contact with one another in material 30 or are otherwise in sufficiently close proximity to one another to enable, facilitate or enhance heat transfer amongst conductive elements 28 within material 30 and/or body 12 of glove 10.

In some embodiments, body 12 includes an interior layer 11, or one or more layer portions adjacent thermally conductive elements 28, formed of a non-thermally conductive or insulative material, such as a silicone, a material treated with silicone, a material containing aramid fibers, such as Kevlar or Nomex, or other heat-resistant polymers. In some embodiments, the exterior of body 12 includes material which facilitates the manual manipulation of hair.

As shown in FIG. 5 and FIG. 6, a glove 110 has spaced conductive elements 128 disposed substantially over body 112, including substantially on the entirety of thumb stall 122, finger stalls 124*a-d*, front side 116 and back side 114.

As shown in FIG. 7 and FIG. 8, a glove 210, having spaced conductive elements 228 disposed substantially over body 212 similar to glove 110, but differs from glove 110 in that glove 210 has open fingertip portions on each of thumb stall 222 and finger stalls 224*a-d* to enable fingertips to protrude from body 212 when a hand is inserted in open end 218.

As shown in FIG. 9, a glove 310 includes conductive elements 328 comprising one or more strips of a thermally conductive material, such as a mesh made of thermally conductive material, such as a metal, coupled or adhered to non-thermally conductive elements 326. In some embodiments, body 312 is substantially covered by strips, patches or other portions of mesh conductive elements 328.

In the aforementioned embodiments, thermally conductive elements, such as elements 28, 128, 228 and 328, are exposed to a heat source, such as a blow dryer or hair dryer, from which the thermally conductive elements absorbs heat. The temperature of the thermally conductive elements increases relative to the non-thermally conductive elements until the heat dissipates therefrom. The thermally conductive elements may be in thermal communication with one another to facilitate heat transfer, including the even absorption, delivery and/or distribution of heat throughout the thermally conductive elements.

As shown in FIG. 10 and FIG. 11, a glove 410 includes thermally conductive elements 428 on both front side 416, thumb and finger stalls 422 and 424*a-d*. Glove 410 also includes thermally conductive elements 428 on the back side 414 of glove 410. In this embodiment, thermally conductive elements 428 on front side 416 and thermally conductive elements 428 on back side 414 are in thermal communication through contact with each other.

Generally, gloves as disclosed herein, such as glove 410, are used such that the front side, such as front side 416, contacts another person's hair. Front side 416 thus faces away from the hot air being directed by a hair dryer (not shown) at the person's hair. The hair dryer is often held in the other hand of the user of the glove. Thus, back side 414 may most often be exposed to the hot air from a hair dryer and subsequently absorb a greater amount of heat. The contact between thermally conductive elements 428 on back side 414 and front side 416 enables the absorbed heat to transfer to the thermally conductive elements 428 on front side 416.

As shown in FIG. 12 and FIG. 13, Glove 510 includes a heat source 530, which may be powered by any power source, such as a replaceable or rechargeable battery (not shown) including a temperature setting dial 532 and wiring 534 to transfer heat to thermally conductive elements 528 on front side 516 of glove 510. Heat source 530 may be used to heat the conductive elements 528 to a desirable temperature, such as within the range of 150 to 450 degrees F.

In some embodiments, a glove according to the invention, such as glove 10, 110, 210, 310 or 410, may be placed within, adjacent or in contact with a heat source to transfer heat to the respective conductive elements prior to putting on the glove for use in a hair styling or other application.

A glove of the invention, such as glove 10, 110, 210, 310 or 410, may be configured to provide an indication of temperature, and in particular, an indication of the thermally conductive elements of the glove reaching a temperature which may be unsafe to touch or use, such as through a temperature sensitive light indicator. For example, glove 510 includes a thermometer strip 536 which illuminates to indicate the temperature. Strip 536 may include a scale which provides an indication based on the illumination of when elements 528 are of a temperature which is in a desirable temperature range for use. The scale associated with strip 536 may thus indicate when the temperature of elements 528 is outside of the desirable temperature range. The scale associated with strip 536 may also include ranges based on use, hair dampness, desired dryness and/or hair type, to facilitate use thereof. Strip 536 may be useful as a safety feature or so that a user is notified of when the glove 510 is ready for use. The indication in this embodiment is visible, however, in other embodiments, an audio device may be included that emits audible sounds upon readiness or a detection of unsafe temperature.

As discussed above, the thermally conductive elements are heated by exposure to a heat source, such as the hot air being blown by a hair dryer. A user wearing the glove would then be able to advantageously style their hair using their hands rather than a brush or curling iron, either with or without aiming the hair dryer directly on the hair.

In some embodiments, the glove may include various materials and fibers, such as insulative, non-absorbent or absorbent materials to provide additional advantages. For example, the glove may include an interior insulative layer of material, such as silicone, to protect the hand from heat. In other embodiments, the glove includes absorbent materials. In yet other embodiments, the glove includes ceramic materials having insulative properties. In some embodiments, the glove body as disclosed herein includes thermally conductive elements and non-thermally conductive elements which are woven together as fibers or threads.

The thermally conductive elements can be made of metals, and in particular of highly thermally conductive metals such as for example, copper, brass, aluminum, silver, or alloys thereof. The thermally conductive elements of the invention may also be either partially or fully coated. In some embodiments, the thermally conductive elements are either partially or fully coated with a material having insulative properties, such as ceramic, porcelain, titanium and/or tourmaline, or other material, which, among other things, enhances heat distribution throughout the conductive elements. Thermally conductive elements may be made of carbon and/or a combination of metal and carbon. By way of the selection of the material for the thermally conductive elements, and their quantity, thickness, and arrangement, the thermal conductivity can be optimally adapted to the particular requirements of the glove. The thermally conductive elements can also comprise a core element that has spun thermally conductive wires around it which are made of a material whose specific thermal conductivity is greater than that of the core element, or which has fabric fibers wrapped around conductive fibers, or vice versa.

A glove of the invention may be made of a generally non-thermally conductive material which has moisture absorbent properties, such as cotton, hemp, bamboo, a porous material, sponge, or other material which has the capacity to absorb moisture/water from contact with wet hair to advantageously reduce drying time, among other things.

In some embodiments, any of the gloves of the invention may include materials which are prefilled or capable of containing preparations and products which are useful for hair styling or generally beneficial for a user's hair, such as shampoo powder, oil absorbers, conditioner, gel and the like, which are then capable of being dispensed directly to a user's hair upon use of the glove, with or without the thermally conductive members being heated. For example, the glove may include a porous or microporous material, which may be capable of absorbing such products and then releasing them upon physical pressure, or be connected to a reservoir defined within the glove.

In some embodiments, the glove of the invention is configured to be reversible having adjacent layers which include a layer having the thermally conductive element and a layer of absorbent material. In use, the glove may be used with the layer of absorbent material as the exterior to help dry hair and reversed so that the layer having the thermally conductive element can be used on the hair as discussed herein.

It should be understood that no limitation of the scope of the invention is intended by the examples provided. It should also be understood that the aforementioned embodiments of the invention may be of any size or shape. Any alterations and further modifications of any inventive feature illustrated herein, and any additional applications of the principles of the invention as illustrated herein which would normally occur to one skilled in the relevant art and having possession of this disclosure are to be considered within the scope of the invention claimed.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

While exemplary apparatus, systems and methods of the invention have been described herein and in the accompanying documents, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth herein, by the claims and any equivalents thereto.

The invention claimed is:

1. A glove for use in hair styling applications, comprising:

a glove body with an inner cavity therein generally conforming to a shape of a human hand, an interior insulative layer, the glove body including an outer surface defining a front side with a palm area and an opposing back side of the glove body, a first end portion having an opening to the inner cavity and an opposing second end portion including a plurality of finger stalls extending from the glove body, wherein the opposing back side of the glove body begins at the opening to the inner cavity, extends continuously over and opposing the palm area, and ends at the plurality of finger stalls, the glove body being constructed of a first material; and a plurality of elements coupled to the glove body defining coupled portions of the plurality of elements, the coupled portions of the plurality of elements being in contact with the first material of the glove body, and non-coupled portions of the plurality of elements, wherein the non-coupled portions of the plurality of elements are fully exposed on the outer surface, and wherein the elements of the plurality of elements are in a spaced configuration relative to one another over an entirety of the front side, an entirety of the opposing back side and an entirety of the plurality of finger stalls, the plurality of elements being constructed of a second material, the second material having a property of greater thermal conductivity and thermal diffusivity as compared with the first material, wherein the thermal conductivity of the second material is equal to or greater than 300 W/mK at room temperature, the thermal diffusivity of the second material is greater than $3\times10^{-6}$ $m^2/s$, and the interior insulative layer is constructed of a non-thermally conductive material whereby the interior insulative layer is configured to prevent heat transfer between the plurality of elements and the inner cavity, and wherein the non-coupled portions being fully exposed on the outer surface and the spaced configuration of the plurality of elements are configured such that thermal communication between and throughout the plurality of elements is enabled, whereby the plurality of elements is configured to absorb heat when exposed to an external source of heated air and transfer and diffuse absorbed heat from and between each element of the plurality of elements.

2. The glove of claim 1, wherein the first material has a property of being water absorbent.

3. The glove of claim 1, wherein the first material has a property of being heat resistant.

4. The glove of claim 1, wherein the plurality of elements comprise one or more planar substrates.

5. The glove of claim 4, wherein the one or more planar substrates comprise groups of discs coupled to the glove body on the front side finger stalls and palm area.

6. The glove of claim 5, wherein the groups of discs comprise at least two discs in contact with one another.

7. The glove of claim 5, wherein the groups of discs comprise discs of varying diameter.

8. The glove of claim 1, wherein the first material has a thermal conductivity less than 1 W/mK at room temperature.

9. The glove of claim 1, wherein the plurality of elements are in thermal communication with one another and coupled to the glove body to provide heat transfer to at least the finger stalls and the palm area of the front side.

* * * * *